US006299504B1

(12) United States Patent
Gluckin

(10) Patent No.: US 6,299,504 B1
(45) Date of Patent: Oct. 9, 2001

(54) BRASSIERE INTERRUPTED SUPPORT ELEMENT

(76) Inventor: Gerald Gluckin, 440 E. 57th St., New York, NY (US) 10022

( * ) Notice: Subject to any disclaimer, the term of this patent is extended or adjusted under 35 U.S.C. 154(b) by 0 days.

(21) Appl. No.: 09/708,388

(22) Filed: Nov. 9, 2000

(51) Int. Cl.[7] ..... A41C 3/10
(52) U.S. Cl. ..... 450/41; 450/51
(58) Field of Search ..... 450/41, 45, 46, 450/47, 48, 49, 51, 52

(56) References Cited

U.S. PATENT DOCUMENTS 4,245,644 * 1/1981 Evans ..... 450/41

* cited by examiner

*Primary Examiner*—Gloria M. Hale
(74) *Attorney, Agent, or Firm*—Myron Amer PC

(57) ABSTRACT

An operative arrangement of two halves of a plastic stay fused in a U-shape in encircling relation about a brassiere cup which have facing inboard semi-circular edges where the U-shape is interrupted, thus increasing the extent of the edges that are held against movement by the fusing to contribute to obviating corresponding movement from their position of support during wearing of the brassiere.

1 Claim, 1 Drawing Sheet

BRASSIERE INTERRUPTED SUPPORT ELEMENT

The present invention relates generally to a brassiere support element and, more particularly to a support element of a plastic construction material in a U-shape configuration effectively maintained in its breast-supporting position beneath and in surrounding relation about a cooperating brassiere cup.

EXAMPLE OF THE PRIOR ART

Prior art plastic stays and supports have taken various measures to provide the desired rigidity and yet avoid having the end portions thereof irritate the wearer, minimize movement or "creep" of the stay in the pocket encasing the stay during wear of the brassiere, and an undesirable consequence of "creep," namely, "poke-through" of the pocket particularly after the brassiere has been repeatedly machined laundered.

Such measures are found in the following patents.

U.S. Pat. No. 3,030,633 to Chalfin is directed to plastic strips which, in certain embodiments thereof, have a body portion and tip portions of different resiliency since the tip portions are made from a softer resin material and of a thickness less than that of the body portion. The tip portions also include notches which are provided to sew the strip in place in the brassiere.

U.S. Pat. No. 3,737,606 to Tareau is directed to a U-shape plastic stay which can be made from any one of a variety of cross-sections and which has an aperture in one end thereof for fastening the stay to the brassiere and a joint in the other end thereof for fastening the stay to another stay.

U.S. Pat. No. 3,777,763 to Schwartz and U.S. Pat. No. 3,884,244 to Rowell are directed to U-shape plastic supports which preferably are of rectangular cross-sectional configuration. The Schwartz patent provides that the terminal end closest to the arm of the wearer is twisted out of the plane of the remainder of the support, while the Rowell patent provides a dished-out contour, i.e., the base area of the support is bent slightly forward out of the plane of the end portions and the inner peripheral edge is angularly offset from the outer peripheral edge, and end portions which may have enlarged knobs to substantially reduce or preclude abrasion of the end portions.

However, such measures have made the brassiere costly to manufacture, have not completely eliminated stress from being applied to the wearer by the end portions of the support and/or the side panels of the brassiere and further many of such prior art plastic supports and stays do not provide adequate support and comfort.

Underlying the present invention is the recognition that the condition which gives rise to the aforementioned problem is the width size differences between the plastic stay and the encasing pocket and that eliminating this difference, which allows movement of the stay within the pocket, is a solution. Moreover, this solution is easily achieved by fusing, rather than sewing, the stay in place since fusing can be located almost directly against the edges of the stay. However, fusing alone is not a complete solution unless the fusing is at an optimum extent which effectively holds the stay against movement, particularly lengthwise of its U-shape.

Broadly, it is an object of the present invention to overcome the foregoing and other shortcomings of the prior art in providing U-shape plastic stays to serve as brassiere support elements.

More particularly, it is an object to provide a fused-in-place plastic stay for a brassiere in a modified U-shape in which the modification, consisting of an interruption in the U-shape, adds significantly to the securement of the stay, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
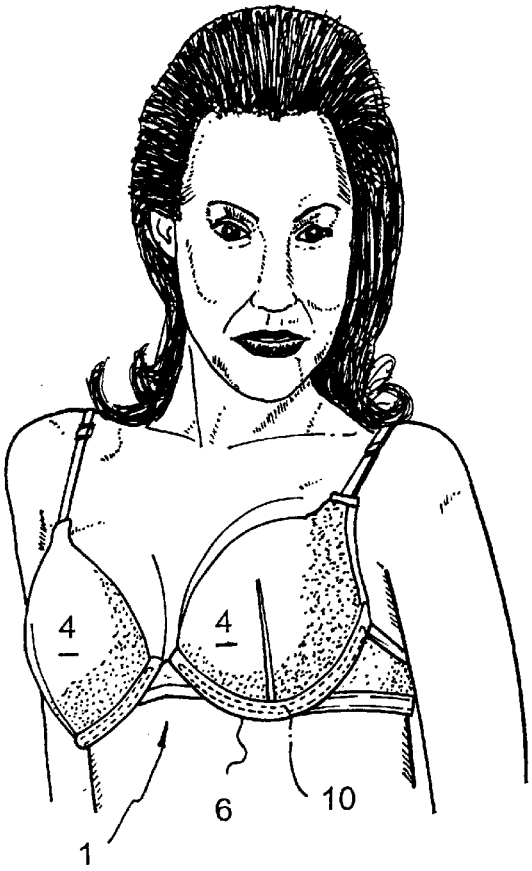
Fig. 1 (Prior Art)
FIG. 1 is a front elevational view of a prior art brassiere with stay supports of choice for the cups of the brassiere.

It is already known that a support, a plastic stay or an underwire, as the case may be, is desired in some types of brassieres to provide upward support of the cup of the brassiere. The upward support can reduce the strain on the shoulders of the brassiere wearer, as well as provide other known benefits. Thus, as exemplified by U.S. Pat. No. 4,646,746 for "Brassiere Support Element" issued to O'Boyle et al. on Mar. 3, 1987, incorporated by this reference in this application pursuant to MPEP 2163.07(b), that as shown in FIG. 1 a practice followed in the prior art is to incorporate in a brassiere 1, under each brassiere cup 4, a semi-circular shaped plastic stay 10 in a pocket 6. Although encased plastic stays, such as stay 10, are useful for the purposes intended, as noted in the '746 patent, there is a need to resist "poke-through" of the brassiere pocket 6 by the stay 10, a problem which is addressed in the '746 patent.

Figure 2:
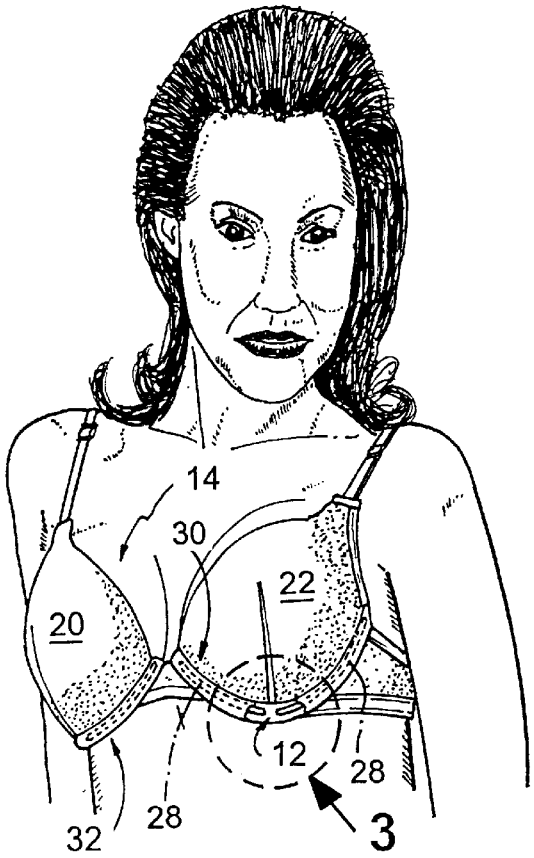
FIG. 2 is a similar front elevational view but of a stay support for the brassiere cups in accordance with the present invention.
Figure 3:
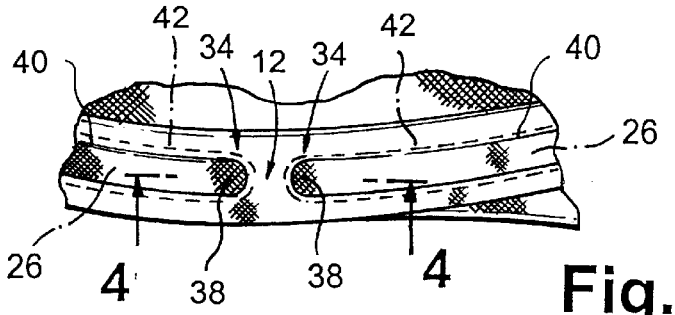
FIG. 3 is a partial view, on an enlarged scale, of the stay support circumscribed within the area of arrow 3 of FIG. 2.
Figure 4:
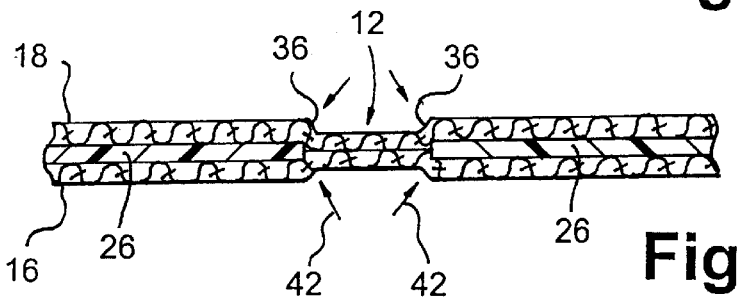
FIG. 4 is a sectional view as taken along lines 4—4 of FIG. 3.

The "poke-through" problem is addressed in the present application, and is solved in a greatly facilitated manner, as best understood from FIGS. 2,3 and 4 and the detailed description which now follows. In summary, the invention contemplates the use of a modified construction of the plastic substantially U-shape integral support 10 used in conjunction with each breast cup 4 of the brassiere 1, in which the modification is an interruption, generally designed 12 in FIG. 2, in the U-shape of the stay.

More particularly, in a preferred embodiment, brassiere 14 has front 16 and rear 18 fabric plies of fusible plastic content fabricated into left 20 and right 22 brassiere breast cups. In right cup 22, as viewed in FIG. 2, and shown in FIGS. 2 and 3, the front fabric ply 16 is broken away to expose the interruption 12 of a U-shape thin gauge, flat, approximately ¼ inch wide, plastic stay, generally designed 26, which consists of two cooperating halves 28 of the full U-shape 30 in an interposed position between the front 16 and rear 18 fabric plies and wherein the U-shape halves 28 are operatively arranged in surrounding relation about a bottom 32 of each brassiere cup 20, 22, approximately at a medial location, and in a selected relation to each other.

The selected relation is that each half 28 at an inboard end 34 has an edge 36 presenting a semi-circular shape 38, and the shapes 38 are in facing relation to each other across the interruption 12, which in a preferred embodiment is approximately 3/16 of an inch, but could vary.

It will be understood that the plastic content-embodied front and rear plies 16, 18 are fused to each other along side edges 40 of the U-shape 30 and, to be specifically noted, about the inboard facing edges 36, the fusing and the location thereof being designated by the reference line 42.

It has been found in practice that the semi-circular shapes 38 increase, as compared with a continuous non-interrupted prior art stay 44, the extent of the fused in place securement 42 of the U-shape stay 30 to minimize inadvertent out of position movement of the stay 30 during wear of the brassiere 14, and due to this increase of fusing 42 significantly obviates the "poke-through" problem.

While the brassiere breast cup disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A plastic substantially U-shaped integral support for use in conjunction with a breast cup of a brassiere including an interruption in said U-shape, said support comprising front and rear fabric plies of fusible plastic fabricated into a said brassiere breast cup, two cooperating halves of said U-shape in an interposed position between said front and rear fabric plies and operatively arranged in surrounding relation about a bottom of said brassiere breast cup and in a selected relation to each other, said halves of said U-shape having semi-circular shapes in ends thereof presenting in said selected relation to each other edges of corresponding semi-circular shapes in facing relation to each other on opposite sides of an interruption of said U-shape at a medial location at a said bottom of said brassiere breast cup, and fusing of said fabric plies to each other along side edges of said U-shape and about facing edges of said interruption of said U-shape.

* * * * *